US005586719A

United States Patent [19]

Katchka

[11] Patent Number: 5,586,719

[45] Date of Patent: Dec. 24, 1996

[54] CONTROL SYSTEM FOR A HOT WATER TANK CONSTRUCTION, CONTROL DEVICE THEREFOR AND METHODS OF MAKING THE SAME

[76] Inventor: Jay R. Katchka, 10455 Hampshire Ct., Cypress, Calif. 90630

[21] Appl. No.: 345,120

[22] Filed: Nov. 28, 1994

Related U.S. Application Data

[63] Continuation of Ser. No. 145,969, Oct. 29, 1993, abandoned, which is a continuation-in-part of Ser. No. 142,491, Oct. 22, 1995, abandoned.

[51] Int. Cl.[6] ..... F23N 5/02; F22B 37/42

[52] U.S. Cl. ..... 236/21 B; 122/504; 431/21

[58] Field of Search ..... 431/16, 21, 22; 122/504; 236/21 B, 68 D

[56] References Cited

U.S. PATENT DOCUMENTS

| | | | |
|---|---|---|---|
| Re. 28,013 | 5/1974 | McLarty | 431/22 |
| 3,236,450 | 2/1966 | Bxby et al. | 236/21 B |
| 3,537,803 | 11/1970 | Ignazio | 431/22 |
| 3,652,195 | 3/1972 | McIntosh et al. | 431/21 |
| 3,948,439 | 4/1976 | Heeger | 236/21 B |
| 4,204,833 | 5/1980 | Kmetz et al. | 431/22 |
| 4,437,829 | 3/1984 | Baker | 431/21 |
| 4,872,830 | 10/1989 | Katchka et al. | 431/54 |
| 4,975,043 | 12/1990 | Katchka et al. | 431/54 |
| 5,143,050 | 9/1992 | Spivey | 126/374 |
| 5,261,598 | 11/1993 | Shirayanagi et al. | 236/21 B |
| 5,280,802 | 1/1994 | Comuzie, Jr. | 137/65 |

*Primary Examiner*—William E. Wayner
*Attorney, Agent, or Firm*—Fulbright & Jaworski LLP

[57] ABSTRACT

A control system for a hot water tank construction, control device therefor and methods of making the same are provided, the control system comprising a switch unit that has a portion thereof disposed remote from a housing of a control device and in a position to sense the temperature of an adverse heat roll out from the combustion chamber of the hot water tank construction and thereby be in an operating condition thereof that prevents an electromagnetic unit carried by the housing of the control device from being in an open condition thereof if the sensed temperature of the heat roll out is above a certain temperature.

20 Claims, 4 Drawing Sheets

CONTROL SYSTEM FOR A HOT WATER TANK CONSTRUCTION, CONTROL DEVICE THEREFOR AND METHODS OF MAKING THE SAME

CROSS REFERENCE TO RELATED APPLICATIONS

This application is a continuation patent application of its parent patent application, Ser. No. 145,969, filed Oct. 29, 1993, now abandoned, which, in turn, is a continuation-in-part patent application of its parent patent application, Ser. No. 142,491, filed Oct. 22, 1993, now abandoned.

It is known to provide a control system for a hot water tank construction having a combustion chamber means, the system comprising a source of fuel, burner means for heating water in the tank construction and being disposed in the combustion chamber means of the tank construction, flame detecting means having means for generating an electrical current when sensing a flame at the burner means, and a control device for interconnecting the source to the burner means, the control device comprising a housing means, an electromagnetic means carried by the housing means, a movable valve means carried by the housing means and normally being disposed in a closed position thereof to prevent the source from reaching the burner means and being adapted to be held in an open position thereof by the electromagnetic means as long as the electromagnetic means remains energized so that the source of fuel can be interconnected to the burner means, the flame detecting means being operatively interconnected to the electromagnetic means to direct the electrical current thereto to energize the electromagnetic means, and a temperature responsive electrical switch means carried by the housing means and being operatively interconnected to the electromagnetic means so that the electromagnetic means is adapted to be energized by the flame detecting means when the switch means is in a first operating condition thereof by sensing a temperature below a certain temperature and is prevented from being energized by the flame detecting means when the switch means is in a second operating condition thereof by sensing a temperature above the certain temperature. For example, see the U.S. Pat. No. to Katchka et al, 4,872,830.

SUMMARY OF THE INVENTION

It is one of the features of this invention to provide a new control system for a water heater or a hot water tank construction that will prevent a flow of fuel from a fuel source to the burner means of the hot water tank construction should an adverse heat roll out occur from the combustion chamber means of the hot water tank construction.

In particular, it is known that the flue system for a hot water tank construction that normally exhausts the combustion products of the burner means of the hot water tank construction can become restricted or inoperative in a manner that causes the combustion products to spill out of the combustion chamber into the area surrounding the hot water tank construction and this can obviously be an undesirable situation if the temperature of such heat roll out is too high.

Therefore, it has been found according to the teachings of this invention that a temperature responsive switch means can have a portion thereof disposed remote from the housing means of a control device and be in a position to sense the temperature of an adverse heat roll out from the combustion chamber means of a hot water tank construction with such switch means preventing the conventional electromagnetic means of the control device from holding a valve means thereof in an open condition should the sensed temperature of the heat roll out be above a certain temperature.

For example, one embodiment of this invention comprises a control system for a hot water tank construction having a combustion chamber means, the system comprising a source of fuel, burner means for heating water in the tank construction and being disposed in the combustion chamber means of the tank construction, flame detecting means having means for generating an electrical current when sensing a flame at the burner means, and a control device for interconnecting the source to the burner means, the control device comprising a housing means, an electromagnetic means carried by the housing means, a movable valve means carried by the housing means and normally being disposed in a closed position thereof to prevent the source from reaching the burner means and being adapted to be held in an open position thereof by the electromagnetic means as long as the electromagnetic means remains energized so that the source of fuel can be interconnected to the burner means, the flame detecting means being operatively interconnected to the electromagnetic means to direct the electrical current thereto to energize the electromagnetic means, and a temperature responsive electrical switch means carried by the housing means and being operatively interconnected to the electromagnetic means so that the electromagnetic means is adapted to be energized by the flame detecting means when the switch means is in a first operating condition thereof by sensing a temperature below a certain temperature and is prevented from being energized by the flame detecting means when the switch means is in a second operating condition thereof by sensing a temperature above the certain temperature, the switch means having a portion thereof disposed remote from the housing means and in a position to sense the temperature of an adverse heat roll out from the chamber means and thereby be in the second operating condition thereof if the sensed temperature of the heat roll out is above the certain temperature.

Accordingly, it is an object of this invention to provide a new control system for a hot water tank construction, the control system of this invention having one or more of the novel features of this invention as set forth above or hereinafter shown or described.

Another object of this invention is to provide a new method of making such a control system, the method of this invention having one or more of the novel features of this invention as set forth above or hereinafter shown or described.

Another object of this invention is to provide a new control device for such a control system, the control device of this invention having one or more of the novel features of this invention as set forth above or hereinafter shown or described.

Another object of this invention is to provide a new method of making such a control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
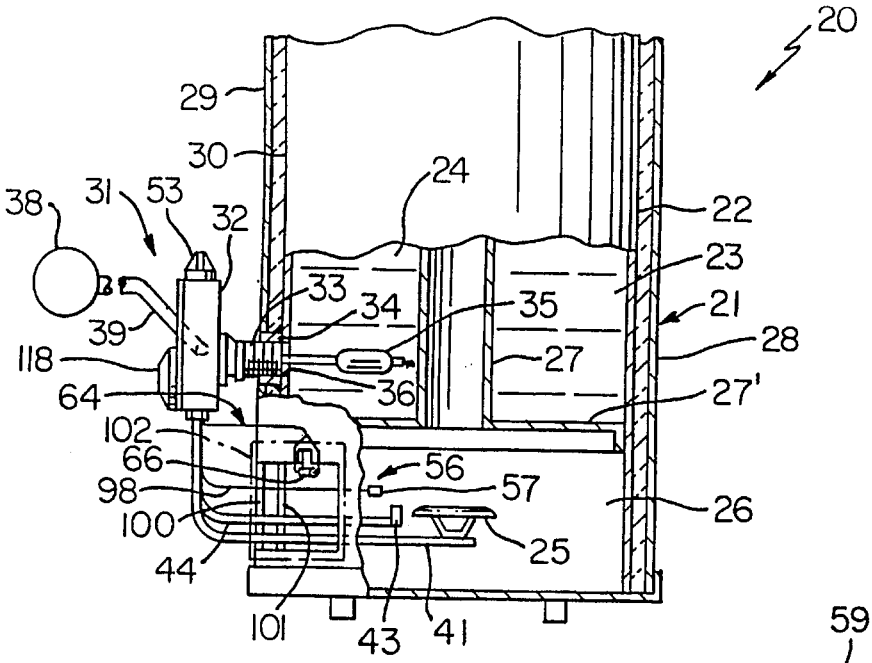
FIG. 1 is a fragmentary side view, partially in cross section, of a hot water tank construction utilizing the new control system of this invention and the new control device of this invention.

While the various features of this invention are hereinafter illustrated and described as being particularly adapted to provide a control system for a water heater or a hot water tank construction of a particular type, it is to be understood that the various features of this invention can be utilized singly or in various combinations thereof to provide a control system for other types of hot water tank constructions, as desired.

Therefore, this invention is not to be limited to only the embodiment illustrated in the drawings, because the drawings are merely utilized to illustrate one of the wide variety of uses of this invention.

Referring now to FIG. 1, the new control system of this invention is generally indicated by the reference numeral 20 and is being utilized for controlling the operation of a water heater or a hot water tank construction that is generally indicated by the reference numeral 21 and comprising an inner tank 22 having a chamber 23 therein for containing water 24 that is to be heated by a burner means 25 disposed in a combustion chamber means 26 for the tank construction 21 in a manner well known in the art, the tank 22 having a central flue 27 extending upwardly from a bottom wall 27' of the chamber 23 for permitting the combustion products of the burner means 25 to pass upwardly therethrough to be carried away in a conventional manner.

In order to provide heat insulation for the tank 22, the hot water tank construction 21 has an outer tank or jacket 28 that surrounds the tank 22 and can have suitable insulation means disposed between a wall means 29 of the jacket 28 and a wall means 30 of the tank 22 also in a manner well known in the art.

The control system 20 of this invention comprises a control device that is generally indicated by the reference numeral 31 in FIG. 1 and comprising a housing means 32 that has an externally threaded shank 33 thereof threadedly disposed in an internally threaded spud 34 carried by the wall 30 of the tank 22 and permitting a temperature sensing rod and tube arrangement 35 of the control device 31 to pass through an opening 36 in the wall 30 to be received in the chamber 23 so as to sense the temperature of the water 24 and operate a valve means (not shown) in the housing means 32 in relation to such sensed temperature in a manner well known in the art. For example, see the aforementioned U.S. Pat. No. to Katchka et al, 4,872,830 as well as the U.S. Pat. No. to Katchka et al, 4,285,662 whereby these two U.S. patents are being incorporated into this disclosure by this reference thereto.

Figure 4:
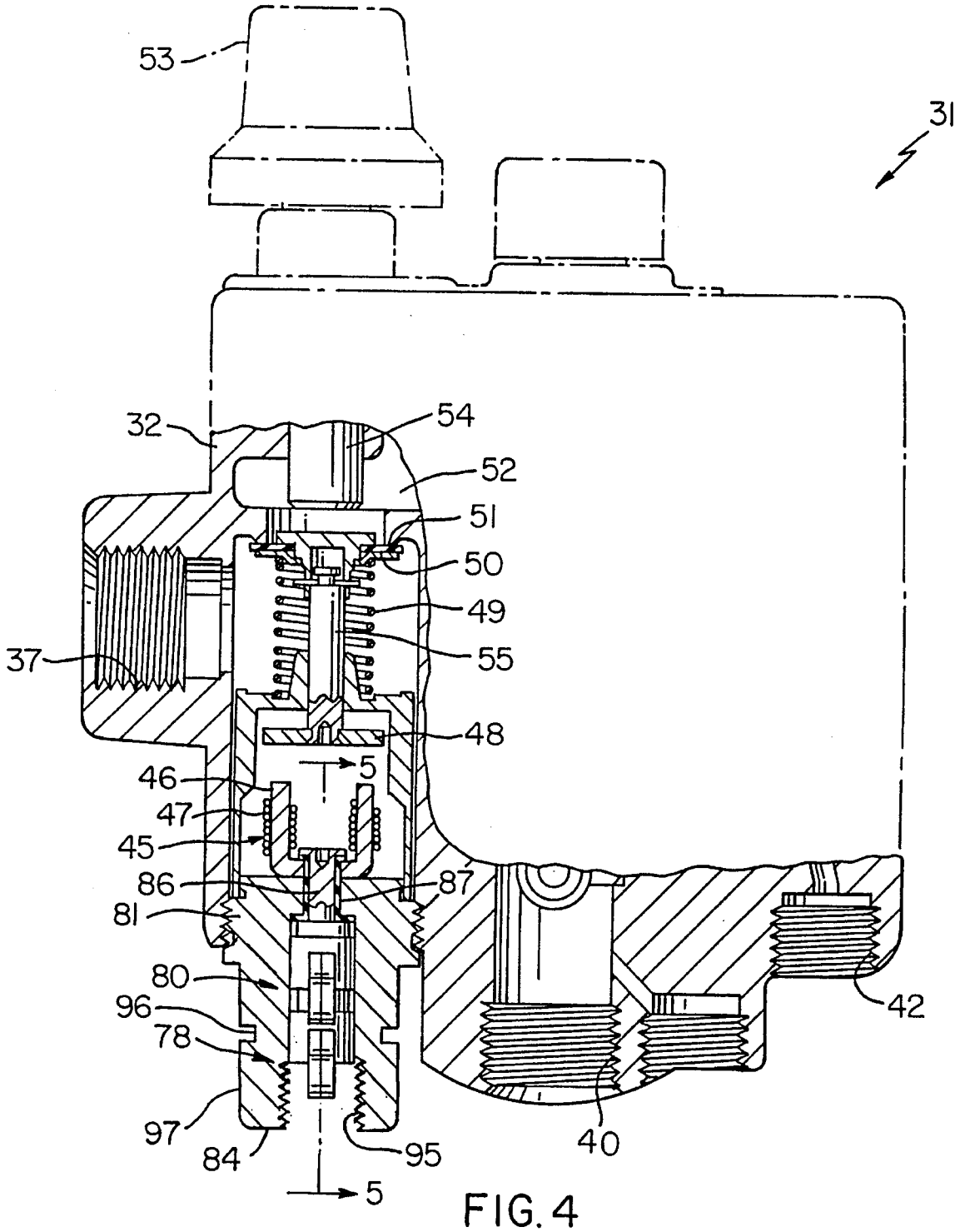
FIG. 4 is an enlarged schematic view, partially in cross section, of the new control device of this invention that is illustrated in FIG. 1.

The housing means 32 of the control device 31 has an inlet 37, FIG. 4, that is interconnected to a gaseous fuel source 38 by a conduit means 39 so that under certain conditions, the control device 31 can interconnect the fuel source 38 to an outlet means 40, FIG. 4, of the housing means 32 so as to be interconnected to the main burner means 25 by a conduit means 41.

Similarly, the control device 31 is adapted to interconnect the fuel source 38 to another outlet means 42 of the housing means 32 under certain conditions with such outlet means 42 being interconnected to a pilot burner means 43 by a conduit means 44, the pilot burner means 43 being adapted to produce a flame that will subsequently ignite fuel that issues from the main burner means 25 in a manner well known in the art.

The housing means 32 of the control device 31 carries an electromagnetic means that is generally indicated by the reference numeral 45 and comprising a core 46 having a coil 47 of electrical wire disposed thereon so that when an electrical current flows through the coil 47 in a manner hereinafter set forth, an armature 48 will be held adjacent the core 46 in opposition to the force of a compression spring 49 that normally tends to urge a valve member 50 against a valve seat 51 to prevent the fuel at the inlet 37 from reaching a chamber 52 in the housing means 32 that is interconnected to the pilot outlet 42 and to the main burner outlet 40 through the aforementioned valve means (not shown) controlled by the rod and tube temperature sensing means 35 in a manner well known in the art.

In this manner, the compression spring 49 normally urges the valve member 50 to its closed position against the valve seat 51 so that no fuel from the inlet 37 can reach the chamber 52 and, thus, to the burner means 25, 43 until the valve member 50 is moved away from the valve seat 51 in opposition to the force of the compression spring 49 and this is accomplished by an operator pushing downwardly on a control knob 53 of the control device 31 so as to cause a plunger 54 to be moved axially downwardly therewith and engage against the valve member 50 and move the same downwardly therewith so that the armature 48 that is interconnected to the valve member 50 by a rod means 55 can be placed adjacent the core 46 of the electromagnetic means 45. With the armature 48 now being held in this down position by the plunger means 54, when an electrical current subsequently flows through the coil means 47, the armature 48 will be held in such down position adjacent the core 46 even though the plunger 54 is released by the operator and returns axially back to the position illustrated in FIG. 4 by a spring force (not shown) whereby the valve member 50 will be held in an open position interconnecting the inlet 37 to the chamber means 52 all in a manner well known in the art.

However, should the electrical current cease to flow through the coil 47 for any reason, the electromagnetic means 45 will cease to operate and thereby the force of the compression spring 49 will drive the valve member 50 upwardly into its closed position against the valve seat 51 to terminate the flow of fuel through the control device 31 so that the burner means 25, 43 can no longer operate.

Figure 2:
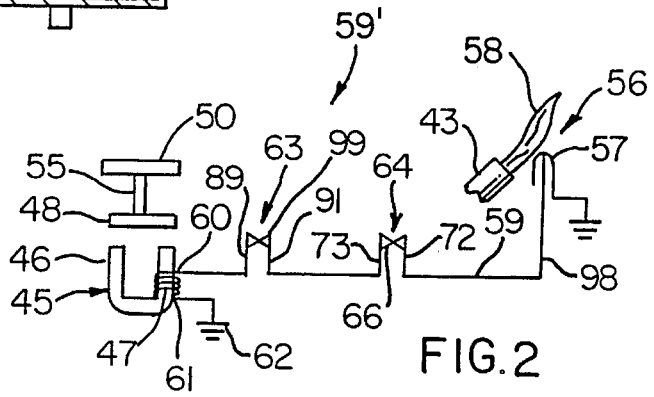
FIG. 2 is a schematic view illustrating the electrical circuit means of the control system of this invention.

The control system 20 of this invention comprises flame detecting means that is generally indicated by the reference numeral 56 in FIGS. 1 and 2 and is of a type well known in the art.

In particular, the flame detecting means 56 comprises a thermocouple 57 that is disposed adjacent the pilot burner means 43 so that when a flame 58 occurs at the pilot burner means 43 being continuously supplied fuel by the control device 31, the thermocouple 57, in a manner well known in the art, generates an electrical current that will flow in an electrical line means 59 of a circuit means 59' of this invention to one side 60 of the coil 47 that has the other side 61 thereof interconnected to ground 62 as illustrated in FIG. 2 whereby the thermocouple 57 is adapted to generate a sufficient flow of electrical current as long as the flame 58 appears at the pilot burner means 43 to operate the electromagnetic means 45 to effectively hold the armature 48 adjacent the core 46 so that the valve member 50 will be held in an open condition relative to the valve seat 51 as previously set forth.

As illustrated in FIG. 2, the electrical line means 59 from the thermocouple 57 to the coil 47 of the electromagnetic means 45 has two temperature responsive electrical switch means 63 and 64 therein, the temperature responsive electrical switch means 63 having a portion (not shown) thereof disposed in the rod and tube temperature sensing unit 35 so as to sense the temperature of the water 24 in the tank 23 and should the temperature of the water 24 exceed a certain high temperature limit, such as approximately 195° F., the switch means 63 will open and thereby terminate the flow of electrical current from the thermocouple 57 through the coil 47 of the electromagnetic means 45 so that the compression spring 49 can drive the valve member 50 to its closed position against the valve seat 51 to terminate the flow of fuel to the burner means 25, 43 as previously set forth.

In a similar manner, the temperature responsive switch means 64 is in series with the switch means 63 in the line means 59 and should the switch means 64 sense a certain temperature, the switch means 64 will open and terminate the flow of electrical current through the line means 59 to the coil 47 so that the spring 49 will move the open valve member 50 to its closed position against the valve seat 51 to terminate the flow of fuel to the burner means 25, 43.

While the control system of the aforementioned U.S. Pat. No. to Katchka et al, 4,872,830 has two temperature responsive switch means in the thermocouple line thereof with one of the switch means having a portion thereof disposed in the temperature sensing rod and tube arrangement thereof in the same manner as the switch means 63 previously described, the other temperature responsive switch means of the U.S. Pat. No. to Katchka et al, 4,872,830 is disposed in the housing of the control device thereof for sensing ambient temperature adjacent such housing means. In contrast, the temperature responsive switch means 64 of this invention has a portion thereof, that is generally indicated by the reference numeral 65 in FIG. 3, disposed remote from the housing means 32 of the control device 31 and is in a position to sense the temperature of an adverse heat roll out from the combustion chamber 26 of the hot water tank construction 21 in a manner hereinafter set forth so that if the temperature of the adverse heat roll out from the combustion chamber 26 is above a certain temperature, such as approximately 220° F. to approximately 230° F., the switch means 64 will open and thereby terminate the operation of the electromagnetic means 45 so that the compression spring 49 can close the valve member 50 against the valve seat 51 to terminate the flow of fuel to the burner means 25, 43.

The portion 65 of the electrical switch means 64 includes a thermally responsive device 66 that has a generally cylindrical casing 67 with a lead 68 extending from one end 69 thereof and another lead 70 extending from the other end 71 thereof with the casing 67 containing suitable structure therein that permits the leads 68 and 70 to be electrically interconnected together as long as the device 66 is sensing a temperature below a certain temperature and will prevent electrical connection between the leads 68 and 70 when the device 66 senses a temperature above that certain temperature. Such a device 66 can be of the "one shot" type wherein once the certain temperature is sensed by the device 66 to disconnect the leads 68 and 70 from each other, the device 66 will never again interconnect the leads 68 and 70 together so that the device 66 must be replaced. While such thermal limiters 66 are well known in the art, the same can comprise a type of device that is set forth in the U.S. Pat. No. to Clapper et al., 4,411,061 or in the U.S. Pat. No. to Brix, 4,514,718 whereby these two U.S. patents are being incorporated into this disclosure by this reference thereto.

The temperature response switch means 63 likewise has such a thermal limiter disposed in the rod and tube temperature sensing means 35 as is well known in the art.

Figure 3:
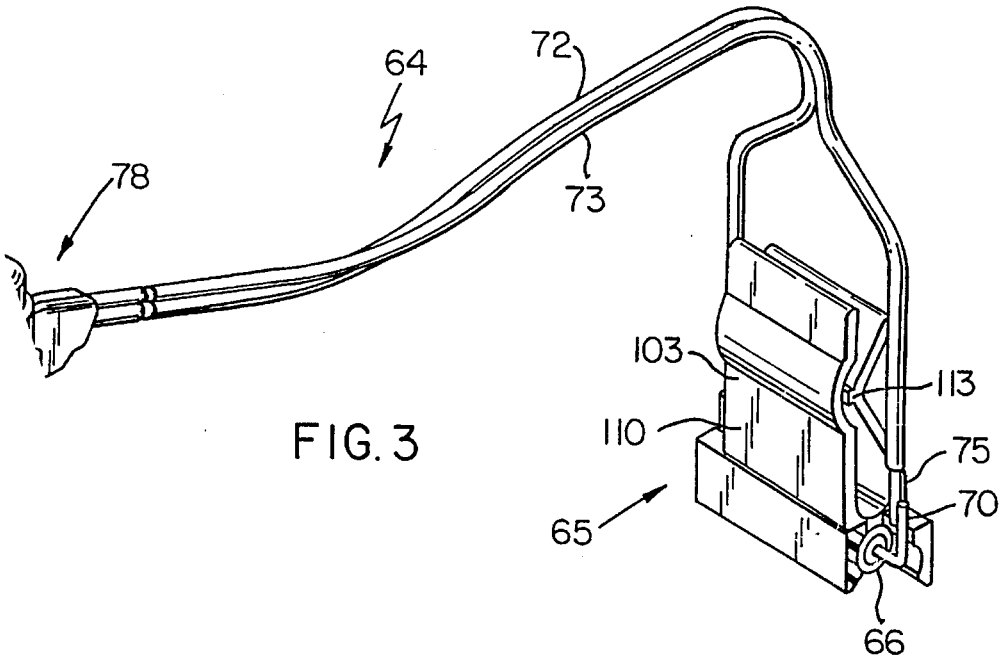
FIG. 3 is an enlarged perspective view of the temperature responsive switch means of this invention that is utilized in the control system and the control device of this invention that are illustrated in FIG. 1.
Figure 5:
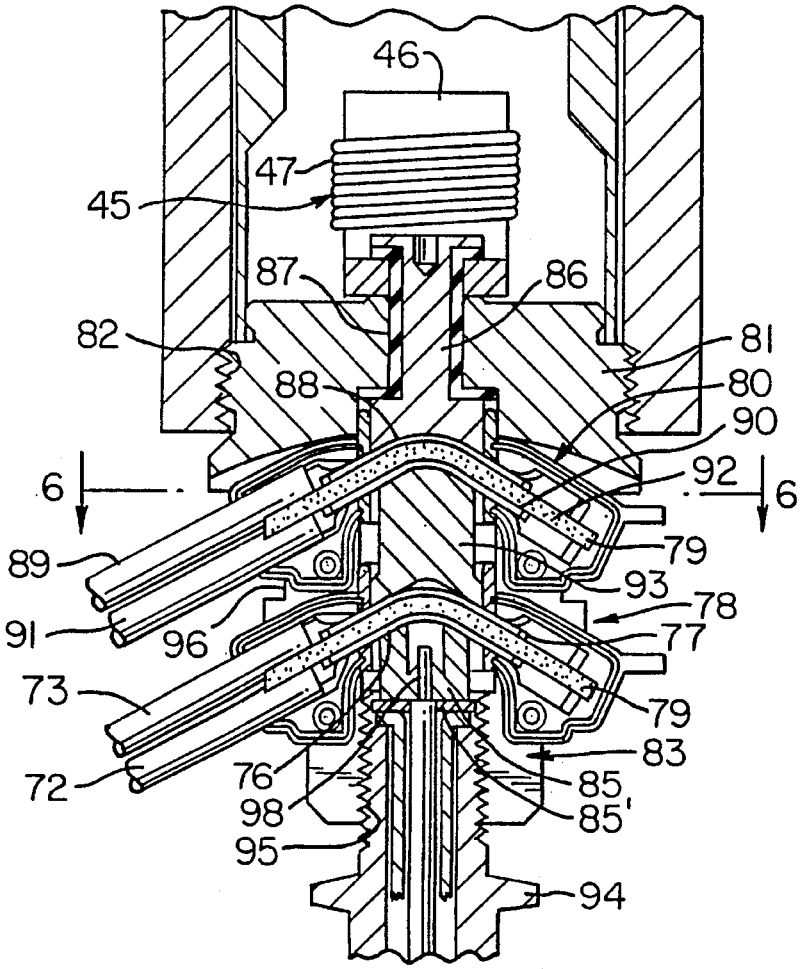
FIG. 5 is an enlarged fragmentary cross-sectional view taken on line 5—5 of FIG. 4.
Figure 6:
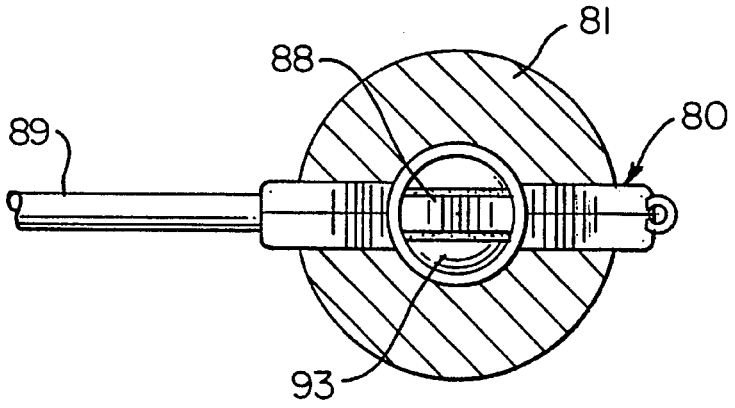
FIG. 6 is a fragmentary cross-sectional view taken on line 6—6 of FIG. 5.
Figure 9:
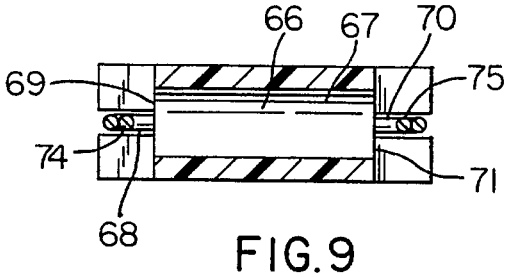
FIG. 9 is a fragmentary cross-sectional view taken on line 9—9 of FIG. 7.

The switch means 64 as illustrated in FIG. 3 and FIG. 9 has two insulated leads 72 and 73 provided with bared ends 74 and 75 that are respectively electrically interconnected to the leads 68 and 70 of the device 66, such as by soldering, and has the other ends 76 and 77 thereof bared and flattened so as to be disposed in another portion of the switch means 64 that is generally indicated by the reference numeral 78 to be carried by the housing means 32 of the control device 31 while being electrically insulated from each other by an insulating member 79 being disposed therebetween as illustrated in FIG. 5.

Such portion 78 of the switch means 64 is substantially identical to a portion 80 of the switch means 63 that is also carried by the housing means 32 of the control device 31 with the portions 78 and 80 being disposed in abutting and stacked relation in a fitting 81 threadedly disposed in a threaded opening 82 in the housing means 32 with the fitting 81 carrying the electromagnetic means 45 as illustrated in FIGS. 4 and 5 whereby the fitting 81 comprises part of the housing means 32.

In particular, the fitting 81 has a slot means 83 interrupting an end 84 thereof so that the portion 80 of the switch means 63 can be first inserted in the slot means 83 until a flattened end 88 of a lead 89 thereof abuts in electrical contact against an electrical contact means 86 of the electromagnetic means 45 that is electrically insulated by means 87 from the remainder of the fitting 81 and is disposed in electrical contact with the end 60 of the coil 47 while the other end 61 of the coil 47 is electrically interconnected to the fitting 81 which, of course, is grounded.

The switch means 63 has a flattened end 90 of another lead means 91 of the switch means 63 electrically insulated from the end 88 of the lead 89 by an insulating member 92 and is adapted to be in electrical contact with a contact member 93 of the portion 78 of the switch means 64 when the portion 78 of the switch means 64 is subsequently disposed in the slot means 83 of the fitting 81 in stacked relation with the portion 80 of the switch means 63 as illustrated in FIG. 5 and being held in such stacked relation by suitable nut portion 94 of the thermocouple 57 threadedly disposed in an internally threaded portion 95 of the fitting 81 as illustrated. The nut portion 94, in a manner conventional in the art, is grounded and carries a contact 85 that is insulated therefrom by insulation means 85' and is disposed in electrical contact with the end 76 of the lead 72.

If desired, the portion 80 of the switch means 63 can be more permanently held in the slot means 83 of the fitting 81 by a suitable wire clip means (not shown) disposed in an annular groove 96 formed in the external peripheral surface 97 of the fitting 81 so that the switch means 63 cannot be readily removed from the control device 31 whereas the switch means 64 of this invention can be more readily removed from the fitting 81 by removing the nut portion 94 to replace the same with a new switch means 64 should the previous switch means 64 have been blown in a manner hereinafter set forth.

Thus, returning to the schematic showing of the circuit means 59' in FIG. 2 and the structure in FIG. 5, the switch means 64 has the end 76 of the lead 72 interconnected by the contact 85 to a part 98 of the lead means 59 that is interconnected to the thermocouple 57 while the end 77 of the lead 73 thereof is interconnected by the contact 93 to the end 92 of the lead 91 of the switch means 63 that has the end 88 of the lead 89 interconnected by the contact member 86 to the end 60 of the coil 47, the other ends 74 and 75 of the leads 72 and 73 of the switch means 64 being respectively interconnected to opposite ends of the thermal limiter 66 while similar opposite ends of the leads 89 and 91 of the switch means 63 are interconnected to opposite ends of a thermal limiter that is indicated by the reference numeral 99 in FIG. 2 and being similar to the thermal limiter 66 except for the opening temperature thereof as previously set forth.

Figure 8:
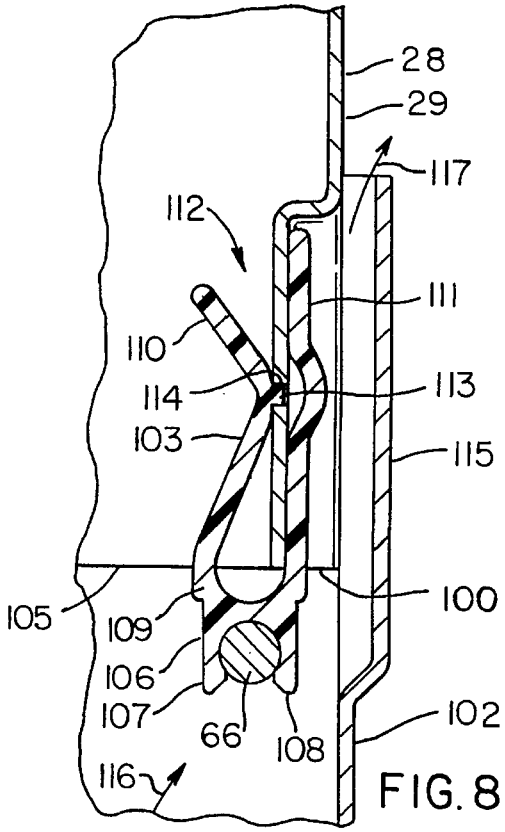
FIG. 8 is a fragmentary cross-sectional view taken on line 8—8 of FIG. 7 and also illustrates the cover or door in its closed position.

As is well known in the art, the outer wall 29 of the jacket 28 of the water heater tank construction 21 has an opening means 100 passing therethrough and being aligned with a similar opening means 101 in the wall 30 of the inner tank 22 so that when such aligned openings 100 and 101 are in an open condition, an operator can reach into the combustion chamber 26 to manually light the pilot burner means 43 when desired, the opening means 101 and 100 being adapted to be respectively closed by suitable replaceable door means, such as the door means 102 illustrated in FIG. 8 for the opening means 100 in the outer jacket 28.

However, such door means 102 for the jacket 28 and the similar door means (not shown) for the opening 101 of the inner tank 22 must provide suitable openings (not shown) therethrough so that the conduit means 41 and 44 as well as the lead means 98 can be disposed therethrough so as to be in the combustion chamber 26 when such door means are in a closed condition thereof. Normally when such door means are closed, there is sufficient clearance between the openings in the door means and the conduit means 41 and 44 so that when an adverse heat roll out condition exists in the combustion chamber 26 by the flue 27 being restricted or closed for some reason, the combustion products tend to spill out of such clearances of the door means with the conduit means 41 and 44 to the exterior of the hot water tank construction 21 and create an undesirable condition as is well known in the art.

Therefore, it was found according to the teachings of this invention that the portion 65 of the switch means 64 of this invention can be disposed adjacent the opening 100 in the outer wall means 29 of the hot water tank construction 21 so as to sense the temperature of any adverse heat roll out condition and cause opening of the switch means 64 should that sensed temperature of the heat roll out condition exceed a certain temperature, such as the temperature of approximately 220° F. to approximately 230° F. as previously described whereby the operation of the burner means 25, 43 will be terminated for the reasons previously set forth and the switch means 64 must then be replaced with a new switch means 64 in order for the control system 20 to thereafter be rendered operative.

One means of this invention for so locating the portion 65 of the switch means 64 is to form the portion 65 with a fastening means 103 which, in the embodiment illustrated in the drawings, comprises a clip means that can be clipped to a part 104 of a peripheral edge means 105 of the wall 29 that defines the opening 100 so that the thermal limiter 66 will be suspended just below that part 104 in the opening 100 behind the door 102 as illustrated in FIG. 8.

Figure 7:
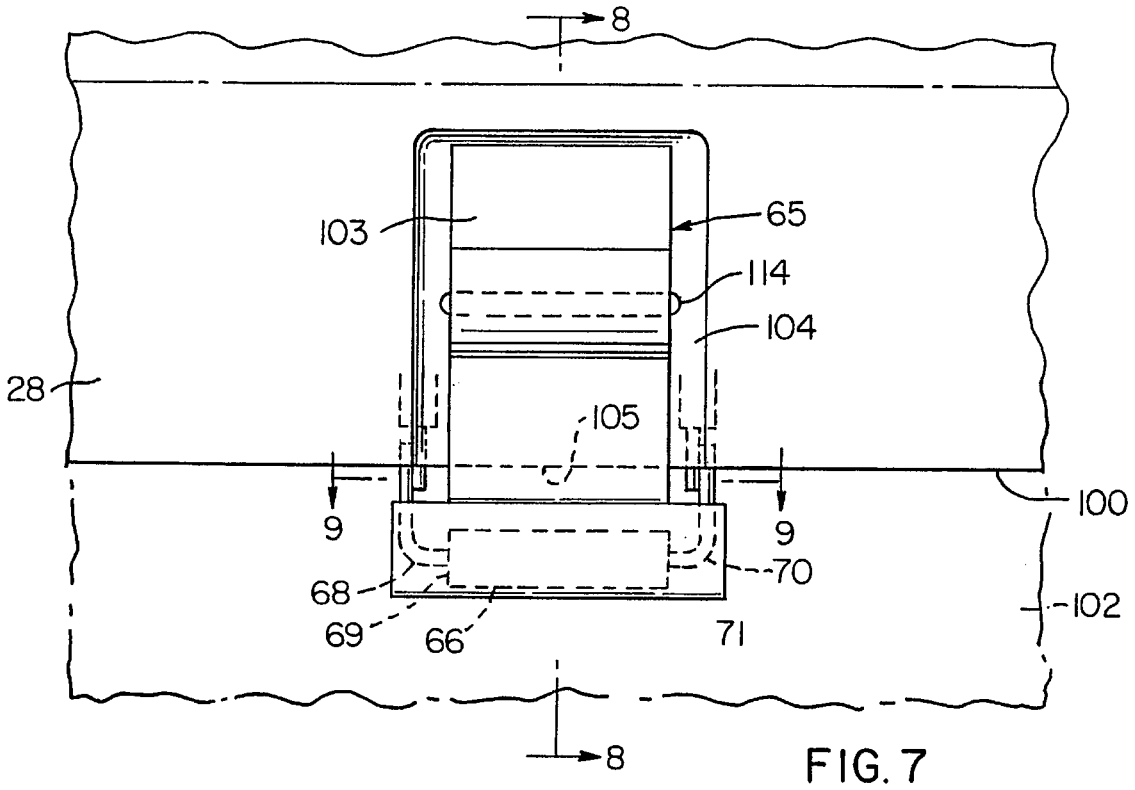
FIG. 7 is an enlarged fragmentary side view of a part of the hot water tank construction of FIG. 7 with the cover or door leading to the combustion chamber means thereof removed.

In particular, the fastening means 103 has a lower portion 106 that defines two flanges 107 and 108 which snap fittingly receive the cylindrical casing 67 of the thermal limiter 66 therebetween as illustrated and an upper portion 109 of the fastening means 103 comprising two flanges 110 and 111 that snap fittingly receive the part 104 of the peripheral edge means 105 of the wall 29 within the bight 112 thereof with the flange 110 having a projection 113 that snap fits into an opening 114 formed through the part 104 of the peripheral edge means 105 of the wall 29 as illustrated in FIG. 8. In addition, the part 104 of the wall 29 is inwardly offset as illustrated in FIGS. 7 and 8 from the remainder of the wall 29 and the door 102 has an adjacent outwardly offset part 115 to cooperate with the offset part 104 to provide a flow path represented by two arrows 116 and 117 in FIG. 8 for the heat roll out of the combustion products of the combustion chamber 26 to pass over the device 66 to have the temperature thereof readily sensed by the device 66.

Thus, merely through the resiliency of the flanges 110 and 111 of the fastening means 103, the portion 65 of the switch means 64 can be readily snap fit in place on the peripheral edge 105 of the opening 100 of the wall 29 so as to position the thermal limiter 66 within the opening 100 at the top portion thereof to function in the manner previously set forth to terminate the operation of the control system 20 should an adverse heat roll out condition exist wherein the thermal limiter 66 detects a temperature of approximately 220° F. or approximately 230° F. depending on the operating temperature of the particular thermal limiter 66 being utilized.

Of course, the portion 65 of the switch means 64 can be fastened to the wall 29 of the hot water tank construction 21 in any other suitable manner. In addition, while the clip means 103 is illustrated as comprising a one-piece part formed of heat insulating material, such as plastic material, it is to be understood that the same could comprise a lower portion 106 of such plastic material and an upper portion 109 formed of another material, such as metallic material, if desired.

Thus, it can be seen that once the control device 31 of this invention has been formed in the manner previously described with the portions 78 and 80 of the switch means 64 and 63 disposed in the abutting stacked relation illustrated in FIGS. 4 and 5 and being electrically interconnected in the manner illustrated in FIG. 2 so that the thermal limiter 99 of the switch means 63 is sensing the temperature of the water 24 in the chamber 23 of the tank 22 and the thermal limiter 66 of the switch means 64 is sensing the temperature in the opening 100 of the outer jacket 29, the control system 20 of this invention is adapted to operate in a manner now to be described.

Should it be desired to start the operation of the control system 20, the operator opens the openings 100 and 101 in the walls 29 and 30 so that the operator can readily light the pilot burner 43 by reaching into the combustion chamber 26. The operator first pushes down on the knob 53 when set in the pilot light position thereof to cause the plunger 54 to move the valve member 50 away from the valve seat 51 and place the armature 48 close to the core 46 of the electromagnetic means 45 so that fuel can now flow from the fuel source 38 through the inlet 37 and the opened valve seat 51 into the chamber 52 and thereby pass out of the pilot outlet 42 to the pilot burner means 43. The operator, while still holding the plunger 54 in its down condition, lights the fuel now issuing out of the pilot burner means 43 so as to create the flame 58 which is sensed by the thermocouple 57 and generates an electrical current flow through the lead means 59 as both switch means 63 and 64 are in a closed condition thereof to permit that electrical current to flow through the coil 47 of the electromagnetic means 45 and thereby hold the armature 48 in its down position so that the valve member 50 is likewise held in its down or open condition once the operator releases the plunger 54 as the operator now sees that the pilot burner 43 has been lit for a sufficient time for the thermocouple 57 to act as set forth above. As long as the flame 58 remains at the pilot burner means 43, the electromagnetic means 45 remains energized to hold the valve member 50 in its open condition. The operator then turns the knob 53 to the on position thereof whereby the control device 31 controls the operation of the burner means 25 by cycling the flow of fuel thereto in a manner well known in the art under the control of the rod and tube temperature sensing unit 35 that causes the water 24 in the chamber 23 of the tank 22 to be heated to the temperature previously selected by the setting of a control knob 118 of the control device 31 and being sensed by the rod and tube temperature sensing means 35 of the control device 31 in a conventional manner.

During the normal operation of the control system 20 in the manner previously described, should a runaway temperature condition occur so that the temperature of the water 24 in the chamber 22 exceeds the high temperature limit of the device 99 of the switch means 63, such as approximately 195° F., the device 99 opens and thereby terminates the flow of electrical current through the coil 47 so that the compression spring 49 can move the valve member 50 against the valve seat 51 and terminate the flow of fuel to the burner means 25, 43 whereby the water 24 in the tank 23 can no longer be heated by the burner means 25.

Thus, before the system 20 can be rendered functional the switch means 63 must be completely replaced.

Similarly, during the normal operation of the system 20 in the manner previously described should an adverse heat roll out condition exist, such as by the flue 27 being restricted or closed, so that the combustion products in the chamber 26 tend to spill out of the same through the door means at the openings 101 and 100 of the wall means 30 and 29, if such door means are there for the opening 101 and/or opening 100 or for one reason or another do not have such door means in place, the temperature responsive electrical switch means 64 will have the device 66 sense the temperature of such spill out of the combustion products and should the temperature thereof exceed the limit of such device 66, such as the aforementioned 220° F. or 230° F., the limiter 66 will open and thereby cause the flow of electrical current through the coil 47 to cease so that the compression spring 49 will close the valve member 50 against the valve seat 51 and thereby terminate the flow of fuel to the burner means 25, 43 so that the burner means 25, 43 can no longer be operating to create the adverse heat roll out situation.

Therefore, the blown switch means 64 must be changed before the control system of this invention can be rendered operable to operate in the manner previously set forth.

Therefore, it can be seen that this invention not only provides a new control system for a hot water tank construction and a new control device for such a system, but also this invention provides a new method of making such a control system and a new method of making such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a combination of a hot water tank construction having a combustion chamber means, a source of fuel, burner means for heating water in said tank construction and being disposed in said combustion chamber means of said tank construction, flame detecting means having means for generating an electrical current when sensing a flame at said burner means, and a control device for interconnecting said source of fuel to said burner means, said control device comprising a housing means, an electromagnetic means carried by said housing means, a movable valve means carried by said housing means and normally being disposed in a closed position thereof to prevent said source from reaching said burner means and being adapted to be held in an open position thereof by said electromagnetic means as long as said electromagnetic means remains energized so that said source of fuel can be interconnected to said burner means, said flame detecting means being operatively interconnected to said electromagnetic means to direct said electrical current thereto to energize said electromagnetic means, and a temperature responsive electrical switch means carried by said housing means and being operatively interconnected to said electromagnetic means so that said electromagnetic means is adapted to be energized by said flame detecting means when said switch means is in a first operating condition thereof by sensing a temperature below a certain temperature and is prevented from being energized by said flame detecting means when said switch means is in a second operating condition thereof by sensing a temperature above said certain temperature, the improvement wherein said switch means has a portion thereof disposed remote from said housing means and in a position to sense the temperature of an adverse heat roll out from said chamber means and thereby be in said second operating condition thereof if said sensed temperature of said heat roll out is above said certain temperature, said tank construction having wall means, said portion of said switch means being fastened to said wall means, said wall means having an opening means therethrough and defined by peripheral edge means of said wall means, said portion of said switch means having a part thereof comprising a fastening means and being fastened by said fastening means to a part of said peripheral edge means of said wall means.

2. A combination as set forth in claim 1 wherein said portion of said switch means comprises a temperature sensing unit, said fastening means suspending said temperature sensing unit of said portion of said switch means into said opening means below said part of said peripheral edge means.

3. A combination as set forth in claim 2 wherein said tank construction has a door means closing said opening means and having a peripheral edge means, part of said peripheral edge means of said door means being stepped outwardly adjacent said portion of said switch means to provide a flow path for said heat roll out from said chamber means.

4. A combination as set forth in claim 2 wherein said part of said peripheral edge means is stepped inwardly from the remainder of said wall means.

5. A combination as set forth in claim 1 wherein said fastening means comprises a clip that is snap-fitted to said part of said peripheral edge means.

6. A combination as set forth in claim 5 wherein said part of said peripheral edge means of said wall means has a slot therein, said clip having a part thereof snap-fitted into said slot.

7. A combination as set forth in claim 1 wherein said switch means is in series with said electromagnetic means so that said electromagnetic means cannot be energized if said switch means is in an open condition thereof, and a high temperature limit switch carried by said control device and being in series with said switch means and said electromagnetic means.

8. A combination as set forth in claim 7 wherein said switch means and said switch each has a part thereof carried by said housing means of said control device.

9. A combination as set forth in claim 8 wherein said parts of said switch means and said switch that are carried by said housing means are disposed in abutting stacked relation in said housing means.

10. A hot water tank construction having a wall means and having a combustion chamber for receiving a burner means therein for heating water contained in said tank construction, said wall means having an opening means therethrough that leads to said combustion chamber, said wall means having peripheral edge means defining said opening means, the improvement wherein a part of said peripheral edge means of said wall means is inwardly stepped whereby a portion of a switch means can be fastened to said part and sense an adverse heat roll out from said combustion chamber.

11. A hot water tank construction as set forth in claim 10 wherein said part of said peripheral edge means has a slot means therethrough to snap-fittingly receive a part of a clip means of said portion of said switch means.

12. A hot water tank construction as set forth in claim 11 and comprising a door means closing said opening means and having a peripheral edge means, part of said peripheral edge means of said door means being stepped outwardly so as to be adjacent said portion of said switch means to provide a flow path for said heat roll out from said chamber means.

13. A hot water tank construction having a wall means and having a combustion chamber for receiving a burner means therein for heating water contained in said tank construction, said wall means having an opening means therethrough that leads to said combustion chamber, said wall means having peripheral edge means defining said opening means, said tank construction having a door means closing said opening means and having peripheral edge means, the improvement wherein a part of said peripheral edge means of said wall means is adapted to have a portion of a switch means fastened thereto to sense an adverse heat roll out from said combustion chamber and wherein part of said peripheral edge means of said door means is stepped outwardly so as to be adjacent said portion of said switch means to provide a flow path for said heat roll out from said chamber means.

14. In a control device of a control system for a hot water tank construction having a combustion chamber means, said system comprising a source of fuel, burner means for heating water in said tank construction and being disposed in said combustion chamber means of said tank construction, flame detecting means having means for generating an electrical current when sensing a flame at said burner means, and said control device for interconnecting said source to said burner means, said control device comprising a housing means, an electromagnetic means carried by said housing means, a movable valve means carried by said housing means and normally being disposed in a closed position thereof to prevent said source from reaching said burner means and being adapted to be held in an open position thereof by said electromagnetic means as long as said electromagnetic means remains energized so that said source of fuel can be interconnected to said burner means, said flame detecting means being carried by said housing means and being operatively interconnected to said electromagnetic means to direct said electrical current thereto to energize said electromagnetic means, and a temperature responsive electrical switch means carried by said housing means and being operatively interconnected to said electromagnetic means so that said electromagnetic means is adapted to be energized by said flame detecting means when said switch means is in a first operating condition thereof by sensing a temperature below a certain temperature and is prevented from being energized by said flame detecting means when said switch means is in as an economic operating condition thereof by sensing a temperature above said certain temperature, the improvement wherein said switch means has a portion thereof that is adapted to be disposed remote from said housing means and in a position to sense the temperature of an adverse heat roll out from said chamber means and thereby be in said second operating condition thereof if said sensed temperature of said heat roll out is above said certain temperature, said portion of said switch means being adapted to be fastened to wall means of said tank construction, said wall means having an opening means therethrough and defined by peripheral edge means of said wall means, said portion of said switch means having a part thereof comprising a fastening means and being adapted to be fastened by said fastening means to said peripheral edge means of said wall means.

15. A control device as set forth in claim 14 wherein said portion of said switch means comprises a temperature sensing unit, said fastening means being adapted to suspend said temperature sensing unit of said portion of said switch means into said opening means below part of said peripheral edge means.

16. A control device as set forth in claim 15 wherein said fastening means comprises a clip that is adapted to be snap-fitted to said part of said peripheral edge means.

17. A control device as set forth in claim 16 wherein said clip is also snap-fitted to said temperature sensing unit.

18. A control device as set forth in claim 14 wherein said switch means is in series with said electromagnetic means so that said electromagnetic means cannot be energized if said switch means is in an open condition thereof, and a high temperature limit switch carried by said control device and being in series with said switch means and said electromagnetic means.

19. A control device as set forth in claim 18 wherein said switch means and said switch each has a part thereof carried by said housing means of said control device.

20. A control device as set forth in claim 19 wherein said parts of said switch means and said switch that are carried by said housing means are disposed in abutting stacked relation in said housing means.

* * * * *